US006818072B2

(12) United States Patent
Kondo et al.

(10) Patent No.: US 6,818,072 B2
(45) Date of Patent: Nov. 16, 2004

(54) HIGH-STRENGTH HEAT-RESISTANT STEEL, PROCESS FOR PRODUCING THE SAME, AND PROCESS FOR PRODUCING HIGH-STRENGTH HEAT-RESISTANT PIPE

(75) Inventors: Masayuki Kondo, Nagasaki (JP); Nobuhiko Nishimura, Nagasaki (JP); Masashi Ozaki, Nishisonogi-gun (JP); Masahiro Kobayashi, Nagasaki (JP); Akira Shiibashi, Yokohama (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 66 days.

(21) Appl. No.: 10/195,389

(22) Filed: Jul. 16, 2002

(65) Prior Publication Data

US 2003/0094221 A1 May 22, 2003

(30) Foreign Application Priority Data

Jul. 19, 2001 (JP) ..... 2001-219604
Apr. 8, 2002 (JP) ..... 2002-105573

(51) Int. Cl.[7] ..... C22C 38/12; C22C 38/02; C22C 38/24; C21D 8/00

(52) U.S. Cl. ..... 148/320; 148/333; 148/334; 148/335; 148/653

(58) Field of Search ..... 148/320, 333–335, 148/653; 420/127

(56) References Cited

U.S. PATENT DOCUMENTS

| | | | | |
|---|---|---|---|---|
| 5,211,909 A | * | 5/1993 | Iseda et al. | 420/106 |
| 6,238,493 B1 | * | 5/2001 | Lin et al. | 148/335 |
| 6,299,705 B1 | * | 10/2001 | Nishimura et al. | 148/328 |
| 6,565,682 B2 | * | 5/2003 | Nishimura et al. | 148/590 |

FOREIGN PATENT DOCUMENTS

| | | | | |
|---|---|---|---|---|
| EP | 0 347 156 | | 12/1989 | |
| EP | 0 787 813 | | 8/1997 | |
| EP | 0845544 A1 | * | 6/1998 | C22C/38/32 |
| EP | 0 924 312 | | 6/1999 | |
| EP | 0 949 340 | | 10/1999 | |
| EP | 0 989 196 | | 3/2000 | |
| EP | 1 081 245 | | 3/2001 | |
| GB | 1 491 729 | | 11/1977 | |
| JP | 1-316441 | | 12/1989 | |
| JP | 2-250941 | | 10/1990 | |
| JP | 7-150245 | | 6/1995 | |
| JP | 10-204572 | * | 8/1998 | |
| JP | 2000-160280 | | 6/2000 | |

OTHER PUBLICATIONS

English abstract of Japanese patent 4–371547, dated Dec. 24, 1992.*
English abstract of Japanese patent 2001–192773, dated Jul. 17, 2001.*

* cited by examiner

*Primary Examiner*—Deborah Yee
(74) *Attorney, Agent, or Firm*—Oblon, Spivak, McClelland, Maier & Neustadt, P.C.

(57) ABSTRACT

A heat resistant steel can be produced at a low cost and has an excellent high temperature strength. A high-strength heat-resistant steel is provided which comprises carbon in an amount of 0.06 to 0.15% by weight, silicon in an amount of 1.5% by weight or less, manganese in an amount of 1.5% by weight or less, vanadium in an amount of 0.05 to 0.3% by weight, chromium in an amount of 0.8% by weight or less, molybdenum in an amount of 0.8% by weight or less, at least one selected from niobium, titanium, tantalum, hafnium, and zirconium in an amount of 0.01 to 0.2% by weight, nitrogen in an amount of 20 to 200 ppm, and the balance being iron and unavoidable impurities, and the high-strength heat-resistant steel comprising a bainite structure.

15 Claims, No Drawings

HIGH-STRENGTH HEAT-RESISTANT STEEL, PROCESS FOR PRODUCING THE SAME, AND PROCESS FOR PRODUCING HIGH-STRENGTH HEAT-RESISTANT PIPE

BACKGROUND OF THE INVENTION

1. Field of the Invention

The present invention relates to high-strength heat-resistant steels, which are suitable for use in a medium-to-high temperature range up to 540° C. and which can be produced at a low cost, processes for producing the high-strength heat-resistant steels, and processes for producing high-strength heat-resistant pipes.

2. Description of the Related Art

Large portions of materials for pressure-sealed parts of piping for used in the highest temperature sections of subcritical-pressure boilers and supercritical-pressure boilers in power plants and waste heat recovery boilers in combined cycle power plants, and semi-high temperature sections of ultra supercritical-pressure boilers, are carbon steels and low alloy steels such as 1Cr steel, 2Cr steel.

Specific examples of low alloy steels which have been used are 0.5Mo steel, (JIS STBA 12), 1Cr-0.5Mo steel, (JIS KA STBA 21, STBA 22, STBA 23), and 2.25Cr-1Mo (JIS STBA 24).

Since large portions of the materials for pressure-tight parts of piping are carbon steels and low alloy steels such as 1Cr steel, 2Cr steel, achievement of sufficient strength of the materials for the parts in which they are used, without increasing the use of alloying elements, would largely contribute to reducing the cost for constructing a power plant.

In Japanese Unexamined Patent Application, First Publication (Kokai), No. Hei 10-195593, the present inventors proposed a steel, having high temperature strength as a material suitable for the above uses, comprising, in % by weight, C in an amount of 0.01 to 0.1%, Si in an amount of 0.15 to 0.5%, Mn in an amount of 0.4 to 2%, V in an amount of 0.01 to 0.3%, Nb in an amount of 0.01 to 0.1%; and the balance being iron and unavoidable impurities. In addition, in Japanese Unexamined Patent Application, First Publication (Kokai), No. 2000-160280, the present inventors also proposed another steel, having high temperature strength comprising, in % by weight, C in an amount of 0.06 to 0.15%, Si in an amount of 0.15% or less, Mn in an amount of 0.5 to 1.5%, V in an amount of 0.05 to 0.3%, at least one selected from Nb, Ti, Ta, Hf, and Zr in an amount of 0.01 to 0.1%, and the balance being iron and unavoidable impurities.

The heat resistant steel proposed as above is a useful steel, which possesses an enhanced high temperature strength in comparison with conventional steels, but which can be produced at a low cost. However, further enhancement of the high temperature strength is desired without increasing the cost.

SUMMARY OF THE INVENTION

An object of the present invention is to provide a high-strength heat-resistant steel comprising; carbon in an amount of 0.06 to 0.15% by weight, silicon in an amount of 1.5% by weight or less, manganese in an amount of 1.5% by weight or less, vanadium in an amount of 0.05 to 0.3% by weight, chromium in an amount of 0.8% by weight or less, molybdenum in an amount of 0.8% by weight or less, at least one selected from niobium, titanium, tantalum, hafnium, and zirconium in an amount of 0.01 to 0.2% by weight, nitrogen in an amount of 20 to 200 ppm, and the balance being iron and unavoidable impurities; and comprising a bainite structure.

Although the high-strength heat-resistant steel contains a small amount of alloying elements, it possesses excellent properties, such a creep rupture strength extrapolated to $10^4$ hours at 550° C. being 130 MPa or greater, due to a dispersion of fine carbonitrides which are stable in an operation temperature range into the metallic structure.

In the high-strength heat-resistant steel, when oxidation resistance is regarded as important, it is preferable for silicon to be contained in an amount of 0.6% by weight or greater.

It is preferable for the high-strength heat-resistant steel to comprise at least one selected from cobalt in an amount of 0.5% by weight or less, nickel in an amount of 0.5% by weight or less, and copper in an amount of 0.5% by weight or less. According to the high-strength heat-resistant steel, hardenability thereof is improved.

In the high-strength heat-resistant steel, it is preferable to comprise phosphorous in an amount of 0.03% by weight or less, sulfur in an amount of 0.01% by weight or less, arsenic in an amount of 0.03% by weight or less, antimony in an amount of 0.01% by weight or less, tin in an amount of 0.01% by weight or less, and oxygen in an amount of 0.01% by weight or less. According to the high-strength heat-resistant steel, a creep ductility thereof is improved.

In the high-strength heat-resistant steel, it is preferable to comprise aluminum in an amount of 0.01% by weight or less and calcium in an amount of 0.01% by weight or less. According to the high-strength heat-resistant steel, a creep ductility thereof is improved.

It is preferable for the high-strength heat-resistant steel to comprise at least one selected from lanthanoid containing lanthanum, cerium, yttrium, ytterbium, and neodymium, and for the total content of the lanthanoid to be in an amount of 0.001 to 0.05% by weight. According to the high-strength heat-resistant steel, a creep ductility thereof is further improved.

The high-strength heat-resistant steel can be produced by a process for producing a high-strength heat-resistant steel, the process comprising the steps of: normalizing a steel at a temperature in the range from 1,100 to 1,250° C., the steel comprising carbon in an amount of 0.06 to 0.15% by weight, silicon in an amount of 1.5% by weight or less, manganese in an amount of 1.5% by weight or less, vanadium in an amount of 0.05 to 0.3% by weight, chromium in an amount of 0.8% by weight or less, molybdenum in an amount of 0.8% by weight or less, at least one selected from niobium, titanium, tantalum, hafnium, and zirconium in an amount of 0.01 to 0.2% by weight, nitrogen in an amount of 20 to 200 ppm, and the balance being iron and unavoidable impurities in a temperature; after that hot working such that a final reduction ratio is 50% or greater the steel at a temperature within the range in which austenite recrystallizes; and then cooling the hot worked product to room temperature or to a temperature lower than the temperature at which the transformation to bainite is completed.

In addition, the high-strength heat-resistant steel can be also produced by a process for producing a high-strength heat-resistant steel, the process comprising the steps of: preparing an ingot comprising carbon in an amount of 0.06 to 0.15% by weight, silicon in an amount of 1.5% by weight or less, manganese in an amount of 1.5% by weight or less, vanadium in an amount of 0.05 to 0.3% by weight, chromium in an amount of 0.8% by weight or less, molybdenum in an amount of 0.8% by weight or less, at least one selected from niobium, titanium, tantalum, hafnium, and zirconium in an amount of 0.01 to 0.2% by weight, nitrogen in an amount of 20 to 200 ppm, and the balance being iron and unavoidable impurities; hot working such that a final reduction ratio is 50% or greater the ingot at a temperature within the range in which austenite recrystallizes during the process of cooling the ingot; and then cooling the hot worked product to room temperature.

In the process for producing a high-strength heat-resistant steel, after the step of hot working at a temperature in which the range in which austenite recrystallizes, it is possible to heat work in a temperature range from 950° C. to the temperature of the $Ar_3$ point and cool to room temperature.

In the process for producing a high-strength heat-resistant steel, it is possible to cool to room temperature and normalize the cooled product in an austenite temperature range, or to temper the cooled product at the temperature of the $A_1$ point or lower temperature. Furthermore, it is also possible to perform both the normalizing treatment and the temper treatment.

In the process for producing a high-strength heat-resistant steel, it is preferable for the steel or the ingot to comprise at least one selected from cobalt in an amount of 0.5% by weight or less, nickel in an amount of 0.5% by weight or less, and copper in an amount of 0.5% by weight or less. According to the production process, hardenability of the high-strength heat-resistant steel is improved.

In the production process of a high-strength heat-resistant steel, it is preferable for the steel or the ingot to comprise phosphorus in an amount 0.03% by weight or less, sulfur in an amount of 0.01% by weight or less, arsenic in an amount of 0.03% by weight or less, antimony in an amount of 0.01% by weight or less, tin in an amount of 0.01% by weight or less, and oxygen in an amount of 0.01% by weight or less. According to the production process, a creep ductility of the high-strength heat-resistant steel is improved.

In the production process of a high-strength heat-resistant steel, it is preferable for the steel or the ingot to comprise aluminum in an amount of 0.01% by weight or less and calcium in an amount of 0.01% by weight or less. According to the production process, a creep ductility of the high-strength heat-resistant steel is improved.

In the production process of a high-strength heat-resistant steel, it is preferable for the steel or the ingot to comprise at least one selected from lanthanoid containing lanthanum, cerium, yttrium, ytterbium, and neodymium, and for the content of the lanthanoid to be in an amount of 0.001 to 0.05% by weight. According to the production process, a creep ductility of the high-strength heat-resistant steel is further improved.

A process for producing a high-strength heat-resistant pipe of the present invention comprises the steps of: normalizing a steel in a temperature range from 1,100 to 1,250° C., the steel comprising carbon in an amount of 0.06 to 0.15% by weight, silicon in an amount of 1.5% by weight or less, manganese in an amount of 1.5% by weight or less, vanadium in an amount of 0.05 to 0.3% by weight, chromium in an amount of 0.8% by weight or less, molybdenum in an amount of 0.8% by weight or less, at least one selected from niobium, titanium, tantalum, hafnium, and zirconium in an amount of 0.01 to 0.2% by weight, nitrogen in an amount of 20 to 200 ppm, and the balance being iron and unavoidable impurities; after that, piercing the steel; and then cooling the pierced product to room temperature.

Another process for producing a high-strength heat-resistant pipe of the present invention comprises the steps of: preparing an ingot comprising carbon in an amount of 0.06 to 0.15% by weight, silicon in an amount of 1.5% by weight or less, manganese in an amount of 1.5% by weight or less, vanadium in an amount of 0.05 to 0.3% by weight, chromium in an amount of 0.8% by weight or less, molybdenum in an amount of 0.8% by weight or less, at least one selected from niobium, titanium, tantalum, hafnium, and zirconium in an amount of 0.01 to 0.2% by weight, nitrogen in an amount of 20 to 200 ppm, and the balance being iron and unavoidable impurities; piercing the ingot at a temperature within the range in which austenite recrystallizes during the process of cooling the ingot; and cooling the pierced product to room temperature.

In the process for producing a high-strength heat-resistant pipe, after the step of cooling to room temperature, it is possible to normalize the cooled product in an austenite temperature range or to temper the cooled product at the temperature of the $A_1$ point or a lower temperature. Furthermore, it is also possible to perform both the normalizing treatment and the temper treatment.

In the following, the reasons for limiting the amounts of each component in the low-alloy heat-resistant steels and the low-alloy heat-resistant pipes of the present invention is described. The amounts of the components are expressed hereinafter on the basis of percentages by weight unless otherwise specified.

Carbon (C in an amount of 0.06 to 0.15%): Carbon combines with V, Nb, or the like, and forms fine carbides, thereby secures the high temperature strength and improves the hardenability. In order to achieve these effects, the high-strength heat-resistant steel of the present invention comprises carbon in an amount of 0.06 to 0.15%. However, since an excess of carbon degrades the weldability. Accordingly, the upper limit of the carbon content is 0.15%. A preferable range of carbon content is in a range from 0.08 to 0.12%.

Silicon (Si in an amount of 1.5% or less): Silicon is an element necessary as a deoxidizer, the high-strength heat-resistant steel of the present invention comprise silicon in an amount of 1.5% or less. In addition, silicon is also effective as an antioxidant. When an antioxidation effect is desired, the silicon content is preferably 0.6% or greater.

Manganese (Mn in an amount of 1.5% or less): Manganese functions as a deoxidizer, similarly to silicon; therefore, manganese is required to prepare the steel. In addition, manganese enhances the hardenability and promotes formation of the bainite. However, since the manganese content is excessive 1.5%, the temperature of the $A_1$ point is reduced, and the upper limit of the manganese content is 1.5%. The preferable manganese content is in a range from 0.8 to 1.2%. When the high-strength heat-resistant steel comprises manganese in the content range, excellent creep rupture properties can be obtained.

Vanadium (V:0.05 to 0.3%): Vanadium combines with C, and forms fine NaCl type carbides. The carbides are extremely stable at high temperatures and enhance the high temperature strength by inhibiting movements of dislocation. In order to achieve this effect, the high-strength heat-resistant steel of the present invention comprises vanadium in an amount of 0.05% or greater. However, when the vanadium content is excessive 0.3%, the effects corresponding to the content cannot be obtained; therefore, the vanadium content is in an amount of 0.3% or less. The preferable content of vanadium is in a range from 0.15 to 0.25%.

Chromium and molybdenum (Cr and Mo in an amount of 0.8% or less respectively): Chromium and molybdenum function to improve the homogeneity of the structure and thereby improve the ductility. In addition, since Cr and Mo also function to improve the hardenability, incorporation of Cr or Mo allows the bainite structure to be easily obtained even when the amount of C or Mn is reduced. In addition, since Cr forms Cr-type carbides, and since Mo is dissolved in the matrix phase, both Cr and Mo are effective in enhancing the creep rupture strength. However, since when either Cr or Mo is excessive 0.8%, a reduction in the cost cannot be achieved, which is inconsistent with the purpose of the present invention, the content of each of Cr and Mo is determined to be 0.8% or less, and preferably in a range from 0.3 to 0.8%.

Niobium, titanium, tantalum, hafnium, and zirconium form NaCl type carbides, similarly to vanadium. However, unlike vanadium, since the solid solubility of niobium, titanium, tantalum, hafnium, and zirconium in the γ range is extremely small, when bulky carbides, such as NbC, are precipitated during the cooling process after dissolution and during a hot forging process, these carbides remain after normalization at a temperature less than 1,100° C. without being dissolved. Such bulky carbides do not contribute to the enhancement of the high temperature strength. Therefore, in the present invention, the temperature for the normalization is set at 1,100° C. or higher to dissolve carbides, such as NbC, and then fine carbides are precipitated. This feature will be described further in detail below.

N (nitrogen in an amount of 20 to 200 ppm) That the high-strength heat-resistant steel comprises nitrogen in an amount of 20 to 200 ppm is a important feature. That is, the high-strength heat-resistant steel comprises nitrogen, and nitrogen combines with niobium, vanadium, titanium, or the like, and forms fine carbonitrides, and thereby the high temperature strength is extremely improved. In addition, since nitrogen has affinity with niobium, vanadium, titanium, or the like, which is larger than that with carbon, even when nitrogen is maintained at high temperatures for long periods, nitrogen does not easily expand, and stable strength can be obtained. When the nitrogen content is excessive 20 ppm, the formation of nitrides, which are effective in improving strength, is sufficient. In addition, when the content of niobium, vanadium, titanium, or the like, which forms NaCl type carbonitrides, is in the above, and the content of nitrogen is excessive 200 ppm, remarkable improvement of strength cannot be obtained. Therefore, the content of nitrogen is in an amount of 20 to 200 ppm.

Co (cobalt in an amount of 0.5% or less) Cobalt is one of the austenite stabilization elements, and has an effect in improving the creep strength. However, when the content of cobalt is excessive, the toughness is degraded. In addition, since cobalt is an expensive alloy element, when the content of cobalt is excessive, the cost for producing the high-strength heat-resistant steel increases. Furthermore, there is the possibility that cobalt is contained in the high-strength heat-resistant steel as unavoidable impurities. Therefore, the content of cobalt is in an amount of 0.5% or less.

Cu (copper in an amount of 0.5% or less) Cu is also one of the austenite stabilization elements, and has an effect in improving the hardenability. However, when the content of copper is excessive, the creep strength and the toughness are degraded. In addition, there is the possibility that copper is contained in the high-strength heat-resistant steel as unavoidable impurities. Therefore, the content of copper is in an amount of 0.5% or less.

Ni (nickel in an amount of 0.5% or less) Nickel is also one of the austenite stabilization elements, and has an effect in improving the hardenability and the toughness. However, when the content of nickel is excessive, the creep strength decreases. In addition, there is the possibility that nickel is contained in the high-strength heat-resistant steel as unavoidable impurities. Therefore, the content of nickel is in an amount of 0.5% or less.

Phosphorus, sulfur, arsenic, antimony, tin, and oxygen are contaminated as impurities. These elements degrade the creep ductility. Therefore, the upper limit of the content is set respectively to 0.03%, 0.01%, 0.03%, 0.01%, 0.01%, and 0.01%.

Aluminum and calcium are necessary as a deoxidizer in steel production. There is the possibility that these element are contaminated as impurities. However, when the content of aluminum and calcium is excessive, the creep ductility and the toughness decrease. Therefore, the upper limit of the content of Al and Ca is set respectively to 0.01% and 0.01%.

When the micro amount of lanthanoid, such as lanthanum, cerium, yttrium, ytterbium, and neodymium is contained, harmful effects of phosphorus, sulfur, arsenic, antimony, and tin can be decreased. In order to achieve this effect, the total content of the at least one of the lanthanoid should be 0.001% or greater. However, when the total content is excessive, the creep ductility and the toughness decrease. Therefore, the upper limit of the total content is set to 0.05%.

Next, the production processes of the present invention will be described.

As described above, a process for producing a high-strength heat-resistant steel comprises the steps of: normalizing a steel at a temperature in the range from 1,100 to 1,250° C., the steel comprising carbon in an amount of 0.06 to 0.15% by weight, silicon in an amount of 1.5% by weight or less, manganese in an amount of 1.5% by weight or less, vanadium in an amount of 0.05 to 0.3% by weight, chromium in an amount of 0.8% by weight or less, molybdenum in an amount of 0.8% by weight or less, at least one selected from niobium, titanium, tantalum, hafnium, and zirconium in an amount of 0.01 to 0.2% by weight, nitrogen in an amount of 20 to 200 ppm, and the balance being iron and unavoidable impurities; after that, hot working the steel at a temperature within the range in which austenite recrystallizes such that a final reduction ratio is 50% or greater; and then cooling the hot worked product to room temperature or to a temperature lower than the temperature at which the transformation to bainite is completed.

A remarkable feature of the process for producing a high-strength heat-resistant steel according to the present invention is that the normalization process is conducted at high temperatures in the range from 1,100 to 1,250° C. That is, although this type of heat resistant steel has been conventionally normalized at a temperature lower than 1,100° C., the normalization process according to the present invention is conducted at a temperature of 1,100° C. or higher, in order to allow fine carbonitrides to be thoroughly dissolved. However, since a temperature is excessive 1,250° C., the crystal grains are considerably bulky, the temperature of the normalization is determined to be 1,250° C. or lower. A preferable temperature of the normalization is in a range from 1,150 to 1,200° C. The temperature of the normalization does not have to be maintained at a constant level, but may vary as long as it is within the above range.

According to the present invention, after the above normalization process, a hot working process is conducted at a temperature within the range in which austenite (γ) recrystallizes. The hot working promotes the recrystallization and divides the fine crystal grains, and allows carbonitrides, such as NbC, to uniformly and finely precipitate in the crystal grains. Because of this structure in which fine carbonitrides are dispersed, the heat resistant steel according to the present invention processes a high strength.

The hot working temperature may vary depending on the composition of the steel; however, a temperature of approximately 950° C. or higher can achieve the purpose of the hot working. However, when the strength is regarded as important and the structure comprising a bainite single phase structure is desired, the hot working temperature is preferably 1,000° C. or higher. The reduction ratio of the hot working should be 50% or greater. This is because a reduction ratio smaller than 50% results in insufficient achievement of the above effects. A preferable reduction ratio is 70% or greater. The hot working is normally carried out as hot rolling.

The above production process is established on the basis of the assumption that an ingot of specific composition is prepared, a sheet is formed by subjecting the ingot to a hot forging process or the like, and the sheet is once cooled, then heated to a specific temperature, then normalized, and then hot worked. However, the high-strength heat-resistant steel of the present invention may be obtained by a process, which is not limited to the above process, in which, for example, an ingot is prepared, the ingot is hot worked, during the process of cooling the ingot, at a temperature within the range in which austenite recrystallizes, and then the hot worked product is cooled to a specific temperature. That is, the high-strength heat-resistant steel can be also produced by a process for producing a high-strength heat-resistant steel, the process comprising the steps of: preparing an ingot comprising carbon in an amount of 0.06 to 0.15% by weight, silicon in an amount of 1.5% by weight or less, manganese in an amount of 1.5% by weight or less, vanadium in an amount of 0.05 to 0.3% by weight, chromium in an amount of 0.8% by weight or less, molybdenum in an amount of 0.8% by weight or less, at least one selected from niobium, titanium, tantalum, hafnium, and zirconium in an amount of 0.01 to 0.2% by weight, nitrogen in an amount of 20 to 200 ppm, and the balance being iron and unavoidable impurities; hot working the ingot at a temperature within the range in which austenite recrystallizes during the process of cooling the ingot such that a final reduction ratio is 50% or greater; and then cooling the hot worked product to room temperature.

In the process for producing a high-strength heat-resistant steel, the ingot under the conditions in which carbonitrides and the other elements are dissolved, is subjected to the hot working process at a temperature within the range in which austenite recrylstallizes so as to obtain effects similar to those obtained by the above production process according to the present invention. According to this production process, since a desired steel can be obtained directly from the ingot without undergoing reheating for forging and normalization, simplification of the production steps and reduction of the production cost can be achieved.

In addition, in the process for producing a high-strength heat-resistant steel, after the above hot working, as a finish hot working (or rolling), a finishing (or rolling) may be carried out at a temperature in the range from 950° C. to the temperature of the $Ar_3$ point. The desired thickness of a sheet or dimensions of a pipe can be obtained by the finishing process.

In the case when the high-strength heat-resistant steel comprises a bainite single phase structure, there is the case in which the room temperature strength is high, and this may inhibit the workability. Therefore, in order to adjust the crystal grain size and to allow the structure to be a ferrite-bainite mixture structure, the normalization process may be conducted at a temperature within the range in which austenite recrystallizes, after the above process. The normalization temperature is preferably the temperature of the finish hot working (or rolling) or lower. When the normalization temperature is more than the temperature of the finish hot working (or rolling), the crystal grains and fine deposits easily expand.

Furthermore, after the cooling process, the steel may be tempered at the temperature of the $A_1$ point or lower. A preferable range of the tempering temperature is (the temperature of the $A_1$ point −50° C.) to the temperature of the $A_1$ point.

When a high-strength heat-resistant pipe such as a boiler pipe is desired, it can be produced by a production process of the present invention, in which a piercing process is conducted instead of the hot working process at a temperature within the range in which austenite recrystallizes in the above production process of the present invention. That is, a process for producing a high-strength heat-resistant pipe of the present invention comprises the steps of: normalizing a steel in a temperature range from 1,100 to 1,250° C., the steel comprising carbon in an amount of 0.06 to 0.15% by weight, silicon in an amount of 1.5% by weight or less, manganese in an amount of 1.5% by weight or less, vanadium in an amount of 0.05 to 0.3% by weight, chromium in an amount of 0.8% by weight or less, molybdenum in an amount of 0.8% by weight or less, at least one selected from niobium, titanium, tantalum, hafnium, and zirconium in an amount of 0.01 to 0.2% by weight, nitrogen in an amount of 20 to 200 ppm, and the balance being iron and unavoidable impurities; after that, piercing the steel; and then cooling the pierced product to room temperature.

Another process for producing a high-strength heat-resistant pipe of the present invention comprises the steps of: preparing an ingot comprising carbon in an amount of 0.06 to 0.15% by weight, silicon in an amount of 1.5% by weight or less, manganese in an amount of 1.5% by weight or less, vanadium in an amount of 0.05 to 0.3% by weight, chromium in an amount of 0.8% by weight or less, molybdenum in an amount of 0.8% by weight or less, at least one selected from niobium, titanium, tantalum, hafnium, and zirconium in an amount of 0.01 to 0.2% by weight, nitrogen in an amount of 20 to 200 ppm, and the balance being iron and unavoidable impurities; piercing the ingot at a temperature within the range in which austenite recrystallizes during the process of cooling the ingot; and cooling the pierced worked product to room temperature.

In the process for producing a high-strength heat-resistant pipe, a piercing process has the same function as that of the hot working process conducted in the process for producing a high-strength heat-resistant steel, and yields the heat resistant pipe. Specific examples of the piercing process are not limited, but a tilting piercing method, a mandrel mill method, and a hot extrusion method can be used.

In addition, in the process for producing a high-strength heat-resistant pipe, after the cooling process to room temperature, as a finishing process, a normalizing process may be conducted at a temperature within the range in which austenite crystallizes. Furthermore, after the cooling process to room temperature, a tempering process at a temperature of the $A_1$ point may be conducted.

In addition, in the process for producing a high-strength heat-resistant pipe, it is possible for the steel or the ingot to comprise at least one selected from cobalt in an amount of 0.5% by weight or less, nickel in an amount of 0.5% by weight or less, and copper in an amount of 0.5% by weight or less.

In addition, in the process for producing a high-strength heat-resistant pipe, it is possible for the steel or the ingot to comprise phosphorous in an amount of 0.03% by weight or less, sulfur in an amount of 0.01% by weight or less, arsenic in an amount of 0.03% by weight or less, antimony in an amount of 0.01% by weight or less, tin in an amount of 0.01% by weight or less, and oxygen in an amount of 0.01% by weight or less.

In addition, in the process for producing a high-strength heat-resistant pipe, it is possible for the steel or the ingot to comprise aluminum in an amount of 0.01% by weight or less and calcium in an amount of 0.01% by weight or less.

Furthermore, in the process for producing a high-strength heat-resistant pipe, it is possible for the steel or the ingot to comprise at least one selected from lanthanoid containing lanthanum, cerium, yttrium, ytterbium, and neodymium, and for the total content of the lanthanoid to be in an amount of 0.001 to 0.05% by weight.

When the steel or the ingot is used, the process for producing a high-strength heat-resistant pipe can obtain effects similar to those obtained by the above the process for producing a high-strength heat-resistant steel according to the present invention.

EXAMPLES

The high-strength heat-resistant steel and the high-strength heat-resistant pipe according to the present invention will be described with reference to examples below.

Each of the steels having the chemical compositions as shown in Table 1 was fused in a vacuum, and then hot forged to produce a sheet having a thickness of 20 mm. Thereafter, the sheet was normalized by heating at 1,200° C. for 20 minutes, hot rolled such that a final reduction ratio is 50% or greater in a temperature range from 950 to 1,050° C., and then air cooled to room temperature. In Table 1, Sample Nos. 1 to 14 and Samples Nos. A1 to A6 were prepared by these processes. Sample Nos. 4 and 13 were prepared, after the hot rolling process, by conducting the normalizing process again at 920° C.

In Table 1, Samples Nos. 1 to 10 and Samples Nos. A1 to A6 are examples according to which the composition and the production process which are within the range of the present invention. Samples Nos. 11 to 14 are comparative examples according to which the composition is outside the range of the present invention.

Microstructures of the prepared Samples were inspected, and the creep rupture strength extrapolated to $10^4$ hours at 550° C. and the tensile strength at room temperature of each Sample were evaluated. The results are shown in Table 2.

TABLE 1

| Sample No | Alloy Composition (% by weight) C | Si | Mn | Cr | Mo | V | Nb | N (ppm) | Other | Fe | Hot rolling temperature (° C.) | Second Normalization temperature (° C.) |
|---|---|---|---|---|---|---|---|---|---|---|---|---|
| Example | | | | | | | | | | | | |
| 1 | 0.10 | 0.34 | 1.20 | 0.66 | 0.50 | 0.21 | 0.04 | 49 | Ti: 0.035 | Bal. | 950 | |
| 2 | 0.09 | 0.33 | 0.98 | 0.67 | 0.49 | 0.23 | 0.04 | 59 | Ti: 0.026 | Bal. | 1,050 | |
| 3 | 0.08 | 0.32 | 0.99 | 0.71 | 0.52 | 0.21 | 0.03 | 48 | Ti: 0.037 | Bal. | 1,050 | |
| 4 | 0.10 | 0.42 | 1.05 | 0.67 | 0.53 | 0.20 | 0.05 | 49 | Ti: 0.019 | Bal. | 1,050 | 920 |
| 5 | 0.11 | 0.43 | 1.03 | 0.68 | 0.51 | 0.19 | 0.06 | 38 | | Bal. | 1,050 | |
| 6 | 0.09 | 0.39 | 0.96 | 0.68 | 0.50 | 0.18 | 0.04 | 41 | Ti: 0.030 | Bal. | 1,050 | |
| 7 | 0.09 | 0.43 | 0.95 | 0.71 | 0.51 | 0.20 | 0.04 | 55 | Zr: 0.032 | Bal. | 1,050 | |
| 8 | 0.08 | 0.43 | 1.04 | 0.71 | 0.49 | 0.21 | 0.04 | 43 | Hf: 0.025 | Bal. | 1,050 | |
| 9 | 0.10 | 0.41 | 1.00 | 0.71 | 0.51 | 0.20 | 0.04 | 20 | Ti: 0.037 | Bal. | 1,050 | |
| 10 | 0.08 | 0.40 | 0.99 | 0.69 | 0.49 | 0.21 | 0.04 | 200 | Ti: 0.038 | Bal. | 1,050 | |
| Al | 0.10 | 0.39 | 1.00 | 0.64 | 0.49 | 0.19 | 0.05 | 47 | Ti: 0.018; P: 0.003; S: 0.002 As: 0.003; Sb: 0.0001; Sn: 0.0006 | Bal. | 1,000 | |
| A2 | 0.09 | 0.42 | 0.95 | 0.67 | 0.53 | 0.18 | 0.05 | 45 | Ti: 0.021; P: 0.003; S: 0.002; O: 0.0019 | Bal. | 1,000 | |
| A3 | 0.09 | 0.40 | 1.02 | 0.62 | 0.53 | 0.18 | 0.04 | 46 | Ti: 0.021; Cu: 0.04, Ni: 0.08 Co: 0.04 | Bal. | 1,000 | |
| A4 | 0.11 | 0.38 | 0.96 | 0.61 | 0.52 | 0.19 | 0.05 | 53 | Ti: 0.019; Al: 0.004; Ca: 0.001 | Bal. | 1,000 | |
| A5 | 0.10 | 0.40 | 0.99 | 0.65 | 0.50 | 0.21 | 0.05 | 52 | Ti: 0.022; La: 0.004; Ce: 0.002 As: 0.01 | Bal. | 1,000 | |
| A6 | 0.10 | 0.40 | 0.99 | 0.65 | 0.50 | 0.21 | 0.05 | 52 | Ti: 0.022; As: 0.01 | Bal. | 1,000 | |
| Comparative Example | | | | | | | | | | | | |
| 11 | 0.10 | 0.38 | 0.97 | 0.71 | 0.51 | 0.19 | 0.04 | 5 | Ti: 0.034 | Bal. | 950 | |
| 12 | 0.11 | 0.36 | 1.02 | 0.67 | 0.52 | 0.20 | 0.03 | 8 | Ti: 0.038 | Bal. | 1,050 | |
| 13 | 0.08 | 0.35 | 1.01 | 0.68 | 0.51 | 0.18 | 0.03 | 6 | Ti: 0.036 | Bal. | 1,050 | 920 |
| 14 | 0.09 | 0.36 | 1.00 | 0.69 | 0.50 | 0.19 | 0.04 | 210 | Ti: 0.037 | Bal. | 1,050 | |

TABLE 2

| | Sample No. | Matrix phase structure | Creep rupture strength (MPa) | Tensile strength at room temperature (MPa) |
|---|---|---|---|---|
| Example | 1 | α + B | 138 | 593 |
| | 2 | B | 147 | 651 |

TABLE 2-continued

| | Sample No. | Matrix phase structure | Creep rupture strength (MPa) | Tensile strength at room temperature (MPa) |
|---|---|---|---|---|
| | 3 | B | 150 | 653 |
| | 4 | α + B | 139 | 595 |
| | 5 | B | 151 | 656 |
| | 6 | B | 150 | 657 |
| | 7 | B | 152 | 643 |
| | 8 | B | 151 | 655 |
| | 9 | B | 150 | 651 |
| | 10 | B | 154 | 658 |
| | A1 | α + B | 132 | 601 |
| | A2 | α + B | 134 | 598 |
| | A3 | B | 140 | 620 |
| | A4 | α + B | 135 | 603 |
| | A5 | α + B | 138 | 592 |
| | A6 | α + B | 131 | 590 |
| Comparative Example | 11 | α + B | 125 | 580 |
| | 12 | B | 141 | 650 |
| | 13 | α + B | 125 | 585 |
| | 14 | B | 138 | 630 |

In Table 2, "B" means that a matrix comprises a bainite single phase structure, and "α+B" means that the matrix comprises multiphase structure comprising ferrite and bainite.

As shown in Table 2, the matrix phase of each of Samples Nos. 2, 3, 5 to 10, 12, 14, and A3 has a single phase bainite structure. In the single phase bainite structure, the average crystal grain size is several tens of micrometers. Fine NaCl type carbonitrides having an average grain size of several tens of nanometers are uniformly dispersed. However, Sample No. A3, for which the hot rolling temperature is 1,000° C., has a single phase bainite structure because it comprises Cu, Ni, and Co.

Samples Nos. 11, A1, A2, and A4 to A6, in which the steel composition is within the range of the present invention but the hot rolling temperature in a range of 950 to 1,000° C., which is lower than that of the present invention, have a multiphase structure comprising ferrite and bainite. The reason why these samples have a multiphase structure comprising ferrite and bainite is because the hot rolling temperature is low and elements are deposited, which improve the hardenability. In the matrix phase structure, fine NaCl type carbonitrides having an average grain size of several tens of nanometers are dispersed.

Sample No. 4, of which the steel composition and the rolling temperature are both within the range of the present invention, but which is conducted by the second normalization process after the hot rolling, has a multiphase structure comprising ferrite and bainite. This is because elements are deposited in the rolling process, which improves the hardenability. In the matrix phase structure, fine NaCl type carbonitrides having an average grain size of several tens of nanometers are dispersed.

As described above, Samples Nos. 1 to 10 and A1 to A6, which are within the range of the present invention, comprises a matrix of a single phase bainite structure or a multiphase structure comprising ferrite and bainite. In addition, in the matrix, fine NaCl type carbonitrides are uniformly dispersed. In contrast, Samples Nos. 11 to 14, which are the comparative examples and outside the range of the present invention, have inferior creep strength, although they are prepared by the same production process and have the same crystal structure as the above examples. This is because fine deposits comprise only carbides, and they cannot form carbonitrides, which is stable for a long period.

In addition, it is confirmed from Tables 1 and 2 that in the steels comprising nitrogen in an amount of 20 to 200 ppm, which are within the range of the present invention, fine carbonitrides, which are stable for a long period at high temperatures, are dispersed. It was thereby confirmed that the steels of the present invention have an improved high temperature strength. In contrast, Samples Nos. 11 to 13 comprising a low content of nitrogen and Sample No. 14 comprising a slightly larger content of nitrogen have inferior creep strength, compared with the steels which comprise the same composition, except the content of nitrogen and which are produced by the same production process.

The creep rupture elongation of Samples Nos. A1 to A6 in the case when the creep rupture test was carried out under 650° C. and 137 MPa is shown in the following Table 3.

TABLE 3

| | Sample No. | Matrix phase structure | Creep rupture elongation (%) |
|---|---|---|---|
| Example | A1 | α + B | 32 |
| | A2 | α + B | 35 |
| | A3 | B | 24 |
| | A4 | α + B | 34 |
| | A5 | α + B | 28 |
| | A6 | α + B | 20 |

The creep rupture elongation of each samples is approximately 20% or greater. In addition, since the content of phosphorous, sulfur, arsenic, antimony, tin, oxygen, aluminum, and calcium is within the range of the present invention, excellent creep ductility was obtained. Since Sample No. A5 comprises lanthanum, and cerium, which are lanthanoid, although it comprises a similar content of arsenic to that of Sample No. A6, it has superior creep rupture elongation to that of Sample No. A6.

Next, an ingot having the composition of Sample No. 3 was prepared, and the ingot was hot worked, during the process of cooling the ingot, at a temperature in the range in which austenite recrystallizes, and was then cooled to room temperature. Thereafter, the microstructure was inspected, and was found to have a structure in which carbonitrides grains having an average grain size of several tens of nanometers were uniformly dispersed in the matrix. The creep rupture strength extrapolated to $10^4$ hours at 550° C. was evaluated to be 152 MPa.

In addition, an ingot having the composition of Sample No. 3 was prepared and the ingot was pierced, during the process of cooling the ingot, at a temperature within the range in which austenite recrystallizes, and was then cooled to room temperature. Thereafter, the microstructure was inspected, and it was found to have a structure in which carbonitride grains having an average grain size of several tens of nanometers were uniformly dispersed in the matrix which has a bainite single phase. The creep rupture strength extrapolated to $10^4$ hours at 550° C. was evaluated to be 152 MPa.

As demonstrated above, since high temperature strength can be secured by conducting the hot working or piercing process at a temperature within the range in which austenite recrystallizes directly after the forging process, the production process according to the present invention contributes to simplification of the production steps and reduction of the production cost.

Furthermore, an ingot having the composition of Sample No. 3 was prepared, and the ingot was hot forged to produce a sheet having a thickness of 20 mm. Thereafter, a normalization process by heating to 1,200° C. for 20 minutes, a hot rolling process such that a final reduction ratio is 50% or greater at 1,050° C., and a finish hot rolling process such that a final reduction ratio is 50% or greater at 950° C., were conducted, and the sheet was cooled to room temperature, normalized at 920° C. or 15 minutes, and then tempered by heating at 650° C. for 30 minutes. Thereafter, the microstructure was inspected, and it was found to have a structure in which carbonitride grains having an average grain size of several tens of nanometers were uniformly dispersed in the matrix. The creep rupture strength extrapolated to $10^4$ hours at 550° C. was evaluated to be 152 MPa.

As explained above, since the high-strength heat-resistant steel of the present invention has specific compositions and in which fine carbonitride grains are dispersed. Therefore, although the high-strength heat-resistant steel of the present invention is low alloy, it has excellent creep rupture strength which cannot be obtained by the conventional high-strength heat-resistant steels. In particular, the high-strength heat-resistant steel of the present invention comprises a bainite single phase structure, and a superior creep rupture strength can be obtained.

In the process for producing a high-strength heat-resistant steel, the process comprises the steps of: normalizing the steel having a specific composition at a temperature in the range from 1,100 to 1,250° C.; after that, hot working the steel at a temperature within the range in which austenite recrystallizes such that a final reduction ratio is 50% or greater; and then cooling the hot worked product to room temperature. Therefore, the high-strength heat-resistant steel can be prepared, which comprises the structure in which carbonitride grains having an average grain size of several tens of nanometers are dispersed. Therefore, although the prepared high-strength heat-resistant steel is a low alloy, it has excellent creep rupture strength which cannot be obtained by the conventional high-strength heat-resistant steels.

In addition, in the other process for producing a high-strength heat-resistant steel, the process comprises the steps of: preparing an ingot comprising a specific composition; hot working the ingot at a temperature within the range in which austenite recrystallizes such that a final reduction ratio is 50% or greater; and cooling the hot worked product to room temperature. Therefore, simplification of the production steps and reduction of the production cost can be achieved. In addition, it is possible to prepare a high-strength heat-resistant steel having excellent creep rupture strength which cannot be obtained by the conventional high-strength heat-resistant steels.

When pipes, such as boiler pipes are prepared, the piercing process at a temperature within the range in which austenite recrystallizes and the cooling process to room temperature may be conducted. According to the process for producing the high-strength heat-resistant pipe, the high-strength heat-resistant pipe can be prepared, which is made of a low alloy, but it has excellent creep rupture strength which cannot be obtained by the conventional high-strength heat-resistant pipes.

What is claimed is:

1. A high-strength heat-resistant steel comprising carbon in an amount of 0.06 to 0.15% by weight, silicon in an amount of 0.6 to 1.5% by weight, manganese in an amount of 1.5% by weight or less, vanadium in an amount of 0.05 to 0.3% by weight, chromium in an amount of 0.8% by weight or less, molybdenum in an amount of 0.8% by weight or less, at least one selected from niobium, titanium, tantalum, hafnium, and zirconium in an amount of 0.01 to 0.2% by weight, nitrogen in an amount of 20 to 200 ppm, and a balance of iron and unavoidable impurities, wherein the high-strength heat-resistant steel comprises a matrix phase consisting of a bainite-ferrite structure.

2. A high-strength heat-resistant steel according to claim 1, wherein the high-strength heat-resistant steel has a creep rupture strength extrapolated to $10^4$ hours at 550° C. of 130 MPa or greater.

3. A high-strength heat-resistant steel according to claim 1, wherein the high-strength heat-resistant steel further comprises at least one of cobalt in an amount of 0.5% by weight or less, nickel in an amount of 0.5% by weight or less, and copper in an amount of 0.5% by weight or less.

4. A high-strength heat-resistant steel according to claim 1, wherein the high-strength heat-resistant steel further comprises phosphorous in an amount of 0.03% by weight or less, sulfur in an amount of 0.01% by weight or less, arsenic in an amount of 0.03% by weight or less, antimony in an amount of 0.01% by weight or less, tin in an amount of 0.01% by weight or less, and oxygen in an amount of 0.01% by weight or less.

5. A high-strength heat-resistant steel according to claim 1, wherein the high-strength heat-resistant steel further comprises aluminum in an amount of 0.01% by weight or less and calcium in an amount of 0.01% by weight or less.

6. A high-strength heat-resistant steel according to claim 1, wherein the high-strength heat-resistant steel further comprises at least one selected from lanthanoid containing lanthanum, cerium, yttrium, ytterbium, and neodymium, and the total content of the lanthanoid is in an amount of 0.001 to 0.05% by weight.

7. A process for producing a high-strength heat-resistant steel, the process comprising normalizing a steel at a temperature in the range from 1,100 to 1,250° C., the steel comprising carbon in an amount of 0.06 to 0.15% by weight, silicon in an amount of 0.6 to 1.5% by weight, manganese in an amount of 1.5% by weight or less, vanadium in an amount of 0.05 to 0.3% by weight, chromium in an amount of 0.8% by weight or less, molybdenum in an amount of 0.8% by weight or less, at least one selected from niobium, titanium, tantalum, hafnium, and zirconium in an amount of 0.01 to 0.2% by weight, nitrogen in an amount of 20 to 200 ppm, and a balance of iron and unavoidable impurities;

after that, hot working the steel at a temperature within the range in which austenite recrystallizes such that a final reduction ratio is 50% or greater;

then cooling the hot worked product to room temperature or to a temperature lower than the temperature at which the transformation to bainite is completed; and producing the steel of claim 1.

8. A process for producing a high-strength heat-resistant steel, the process comprising preparing an ingot comprising carbon in an amount of 0.06 to 0.15% by weight, silicon in an amount of 0.6 to 1.5% by weight, manganese in an amount of 1.5% by weight or less, vanadium in an amount of 0.05 to 0.3% by weight, chromium in an amount of 0.8% by weight or less, molybdenum in an amount of 0.8% by weight or less, at least one selected from niobium, titanium, tantalum, hafnium, and zirconium in an amount of 0.01 to 0.2% by weight, nitrogen in an amount of 20 to 200 ppm, and a balance of iron and unavoidable impurities;

hot working the ingot at a temperature within the range in which austenite recrystallizes during the process of cooling the ingot such that a final reduction ratio is 50% or greater;

then cooling the hot worked product to room temperature; and producing the steel of claim 1.

9. A process for producing a high-strength heat-resistant steel according to claim 7 or 8, wherein the process further comprises, between the hot working and the cooling, hot working in a temperature range from 950° C. to the temperature of the $Ar_3$ point.

10. A process for producing a high-strength heat-resistant steel according to claim 7 or 8, wherein the process further comprises, after the cooling, normalizing the cooled product to a temperature within the range in which austenite recrystallizes.

11. A process for producing a high-strength heat-resistant steel according to claim 7 or 8, wherein the process further comprises, after the cooling, tempering the cooled product to the temperature of the $A_1$ point or lower temperature.

12. A process for producing a high-strength heat-resistant steel according to claim 7 or 8, wherein the steel comprises at least one selected from cobalt, nickel, and copper, and an amount of each of these elements is adjusted respectively to cobalt in an amount of 0.5% by weight or less, nickel in an amount of 0.5% by weight or less, and copper in an amount of 0.5% by weight or less.

13. A process for producing a high-strength heat-resistant steel according to claim 7 or 8, wherein the steel or the ingot further comprises phosphorus in an amount 0.03% by weight or less, sulfur in an amount of 0.01% by weight or less, arsenic in an amount of 0.03% by weight or less, antimony in an amount of 0.01% by weight or less, tin in an amount of 0.01% by weight or less, and oxygen in an amount of 0.01% by weight or less.

14. A process for producing a high-strength heat-resistant steel according to claim 7 or 8, wherein the steel or the ingot further comprises aluminum in an amount of 0.01% by weight or less and calcium in an amount of 0.01% by weight or less.

15. A process for producing a high-strength heat-resistant steel according to claim 7 or 8, wherein the steel comprises at least one selected from lanthanoid containing lanthanum, cerium, yttrium, ytterbium, and neodymium, and the total content of the lanthanoid is in an amount of 0.001 to 0.05% by weight.

* * * * *